US007444916B2

(12) United States Patent
Hirukawa

(10) Patent No.: US 7,444,916 B2
(45) Date of Patent: Nov. 4, 2008

(54) BRAIDING UNIT MOVING TYPE BRAIDING APPARATUS

(75) Inventor: Masao Hirukawa, Kyoto (JP)

(73) Assignee: Murata Kikai Kabushiki Kaisha, Kyoto (JP)

( * ) Notice: Subject to any disclaimer, the term of this patent is extended or adjusted under 35 U.S.C. 154(b) by 0 days.

(21) Appl. No.: 11/705,725

(22) Filed: Feb. 13, 2007

(65) Prior Publication Data

US 2007/0186760 A1 Aug. 16, 2007

(30) Foreign Application Priority Data

Feb. 14, 2006 (JP) ..... 2006-036934

(51) Int. Cl.
*D04C 3/40* (2006.01)

(52) U.S. Cl. ..... 87/34

(58) Field of Classification Search ..... 87/34, 87/62; 57/3, 10

See application file for complete search history.

(56) References Cited

U.S. PATENT DOCUMENTS 2,675,733 A * 4/1954 Hemm et al. ..... 87/34
4,519,290 A * 5/1985 Inman et al. ..... 87/7
5,203,249 A 4/1993 Adams et al.
5,588,290 A * 12/1996 Cobb ..... 57/3

FOREIGN PATENT DOCUMENTS

GB 722542 1/1955
JP 08-276502 10/1996

* cited by examiner

*Primary Examiner*—Shaun R Hurley
(74) *Attorney, Agent, or Firm*—Kirschstein, et al.

(57) ABSTRACT

A braiding unit moving type braiding apparatus is capable of extremely efficiently braiding apparatus is capable of extremely efficiently braiding on a long mandrel having a curved portion. A braiding layer is formed around a mandrel using the braiding unit. The braiding apparatus includes a braiding unit mover which moves the braiding unit along an axis of the mandrel, and the braiding unit mover includes a drive source which is directly or indirectly provided in the braiding unit, and a first guide and/or a second guide which is aligned with the axis of the mandrel as viewed from above and/or the axis of the mandrel as viewed from the side.

6 Claims, 13 Drawing Sheets

BRAIDING UNIT MOVING TYPE BRAIDING APPARATUS

BACKGROUND OF THE INVENTION

1. Technical Field

The present invention relates to a braiding apparatus for forming a braiding layer around a mandrel using a braiding unit, and more particularly, to a braiding unit moving type braiding apparatus capable of obtaining extremely efficient braiding composition according to form (shape, size and the like) of the mandrel.

2. Related Background Art

As is well known, a conventional braiding apparatus is of a mandrel movable type as shown in Japanese Patent Application Laid-open No. H8-276502 (Abstract, FIGS. 1 and 4) in which a braiding unit is fixed, the mandrel is moved with respect to the fixed braiding unit, and a braiding layer is formed around the mandrel.

The mandrel movable type braiding apparatus is applied to a mandrel which is straight and has a certain length, and the physical characteristics such as shape and size of the mandrel to which the braiding apparatus can be applied are limited.

When a mandrel having a long length L (e.g., several meters) and a curved portion as shown in FIG. 1 is to be braided by the conventional mandrel moving type braiding apparatus, since the conventional braiding apparatus chucks one side of the mandrel using a mandrel moving device such as a robot, a moving range of the other side becomes extremely large, it is impossible to chuck and thus, the mandrel is braided in a one-side chucking manner, so that a mandrel having a size of several meters can not be braided because of the tension of a braid yarn or the weight of the mandrel.

SUMMARY OF THE INVENTION

The present invention specifically provides a braiding unit moving type braiding apparatus which can extremely efficiently be used when a long mandrel having a curved portion is to be braided.

To achieve the above object, the present invention provides a braiding unit moving type braiding apparatus in which a braiding layer is formed around a mandrel using the braiding unit, including braiding unit moving means which moves the braiding unit along an axis of the mandrel.

According the invention, in the braiding unit moving type braiding apparatus, the braiding unit moving means includes a drive source which is directly or indirectly provided in the braiding unit, first guide means and/or second guide means which is aligned with an axis of the mandrel as viewed from above and/or an axis of the mandrel as viewed from side.

According to the invention, in the braiding unit moving type braiding apparatus, a rotation center of the braiding unit when it is rotated and moved is located substantially on an extension of a composition point.

According the invention, in the braiding unit moving type braiding apparatus, the braiding apparatus further includes braiding unit moving means which moves the braiding unit in a vertical direction, wherein the braiding unit forms the braiding layer in a state where the braiding unit moves along an axis of the mandrel as viewed from above and the braiding unit moves vertically.

According to the invention, in the braiding unit moving type braiding apparatus, the braiding unit includes a plurality of braiding units.

According to the invention, in the braiding unit moving type braiding apparatus, the plurality of braiding units can move to an operating position and a standby position in accordance with necessity of production.

According to the invention, in the braiding unit moving type braiding apparatus, the plurality of braiding units have different total number of braiding yarn, and/or bobbin carriers of different fibers.

The braiding unit moving type braiding apparatus of the present invention includes the braiding unit moving means which moves the braiding unit along the mandrel. Conventionally, a long mandrel having a curved portion could not be braided, but according to the present invention, such a mandrel can extremely efficiently be braided. In this aspect, the present invention is extremely effective.

In the braiding unit moving type braiding apparatus of the present invention, the braiding unit moving means includes the drive source which is directly or indirectly provided in the braiding unit, first guide means and/or second guide means which align with an axis of the mandrel as viewed from above and/or an axis of the mandrel as viewed from side. Accordingly, the braiding unit moving type braiding apparatus can extremely effectively be applied to a mandrel which is deformed two-dimensionally or three-dimensionally.

DESCRIPTION OF THE PREFERRED EMBODIMENTS

Figure 12:
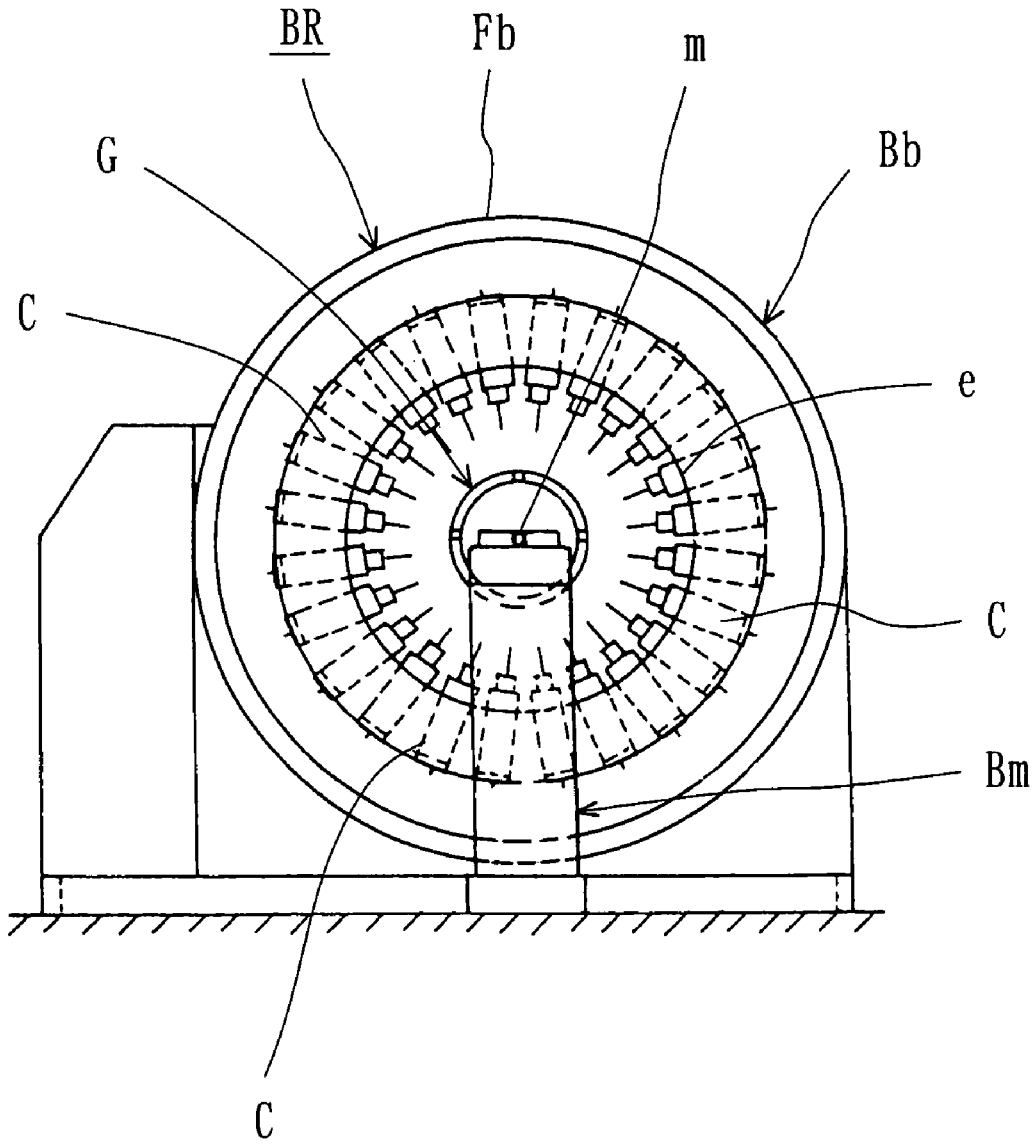
Fig. 12 PRIOR ART
FIG. 12 is a schematic front view showing one example of a basic structure of a conventional mandrel moving type braiding apparatus.
Figure 13:
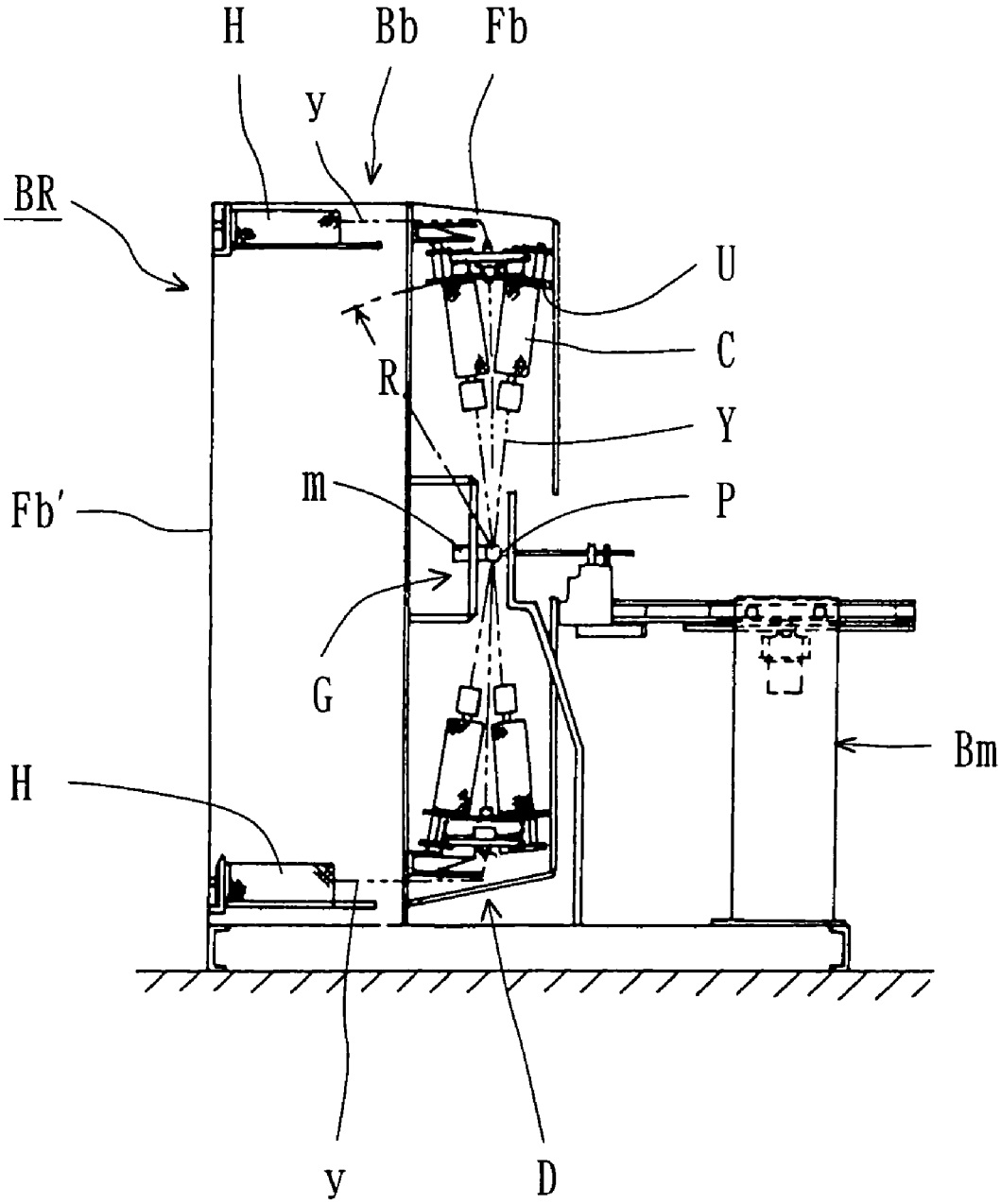
Fig. 13 PRIOR ART
FIG. 13 is a schematic side sectional view of the braiding apparatus shown in FIG. 12.

An example of one basic structure of a conventional mandrel moving type braiding apparatus will be described based on FIGS. 12 and 13. In FIGS. 12 and 13, a braider BR includes a braider body Bb and a mandrel apparatus Bm.

The braider body Bb in the braider BR includes a curved upper plate U having a radius of curvature R. The upper plate U is disposed in a substantially cylindrical machine base Fb. An axis of the machine base Fb extends horizontally, and the machine base Fb is provided at its one side with an opening e. The braider body Bb also includes a bobbin carrier C which runs along a track groove formed in the upper plate U in its circumferential direction. The braider body Bb also includes a drive apparatus D which makes the bobbin carrier C run along the track, and a braid guide apparatus G.

Braid yarn Y, which are pulled out from a bobbin disposed on the bobbin carrier C in an axial direction of the bobbin, are concentrated on the almost center of the upper plate U, and a position of a mandrel m mounted on the mandrel apparatus Bm is set such that a braiding up point P of weave formed on the mandrel m is located at the center of the upper plate U.

The bobbin carrier C is made to run along the track by the drive apparatus D, and the position of the mandrel m is controlled by the mandrel apparatus Bm. As a result, many braid yarns Y cross. If necessary, intermediate yarn y from a bobbin H fixedly disposed substantially horizontally on the frame Fb' of the machine base Fb intersects with the braid yarn Y which is wound back from the bobbin carrier C which runs along the track, and braiding is carried out and a layer is braided on mandrels m of various shapes. According to the present invention, a plurality of braided layers are formed as a product.

Figure 1:
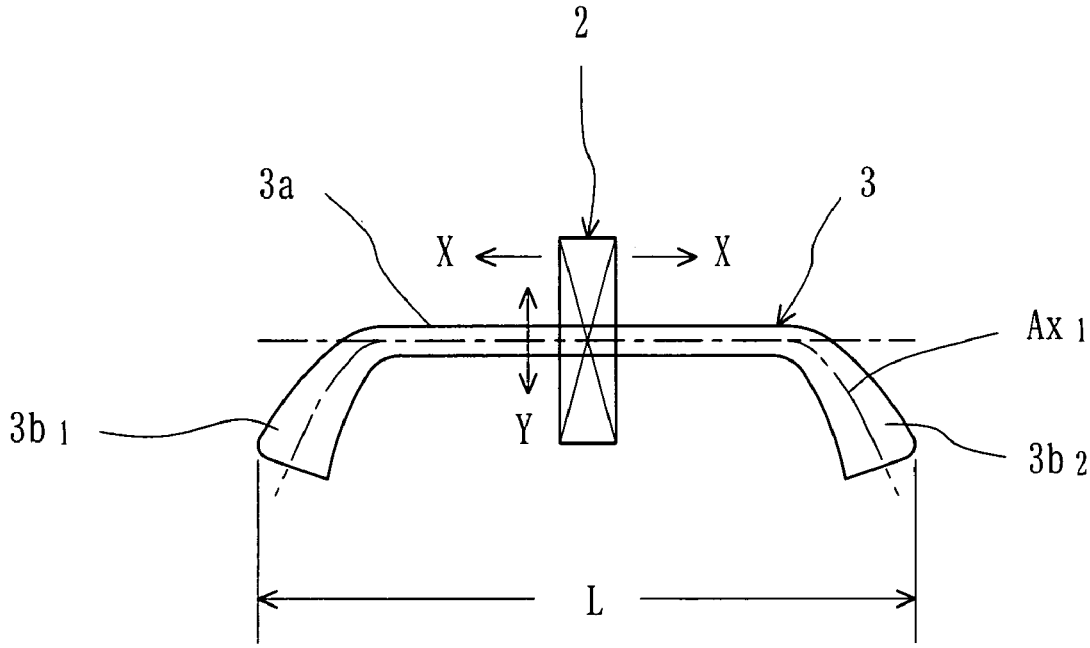
FIG. 1 is a schematic plan view showing a basic structure of the invention in which a movable braiding unit is disposed in one example of a long mandrel having a curved portion.
Figure 2A:
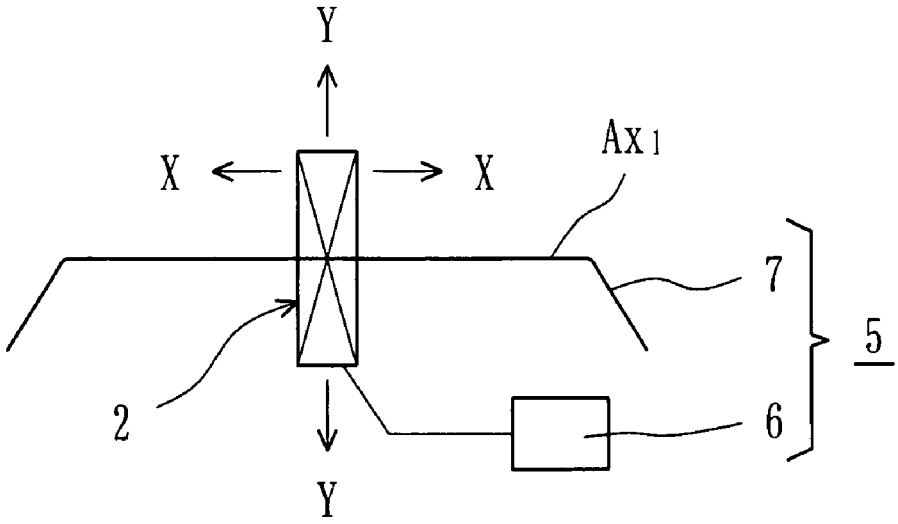
FIG. 2A is a schematic plan view showing a state in which a braiding unit can move in the X and Y axis directions when the mandrel is deformed as viewed from above.
Figure 2B:
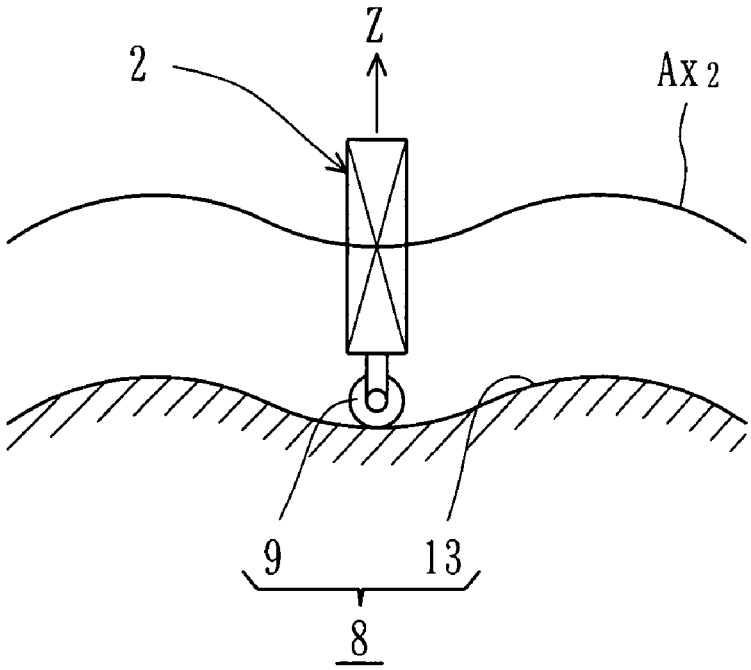
FIG. 2B is a schematic side view showing a state in which a braiding unit can move also in the Z axis direction when the mandrel is deformed as viewed from side.
Figure 3:
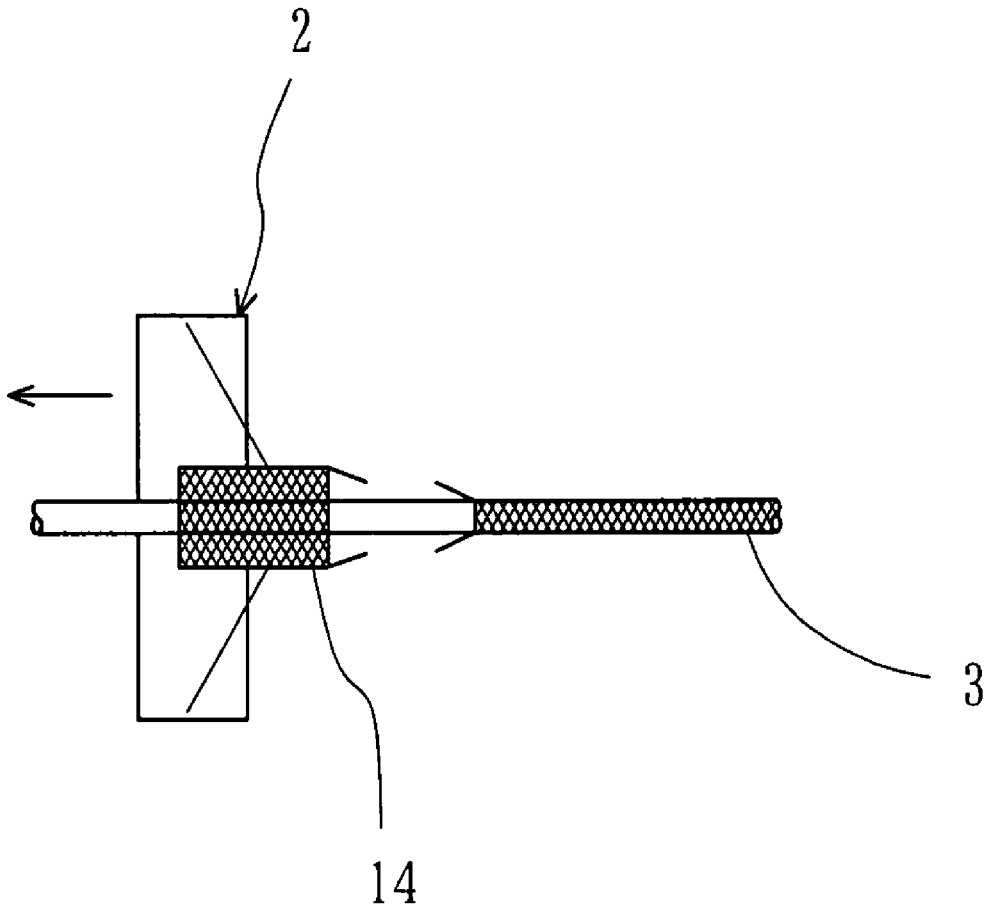
FIG. 3 is a schematic plan view showing an example of use of a braid converging ring when a braiding unit is added.
Figure 4:
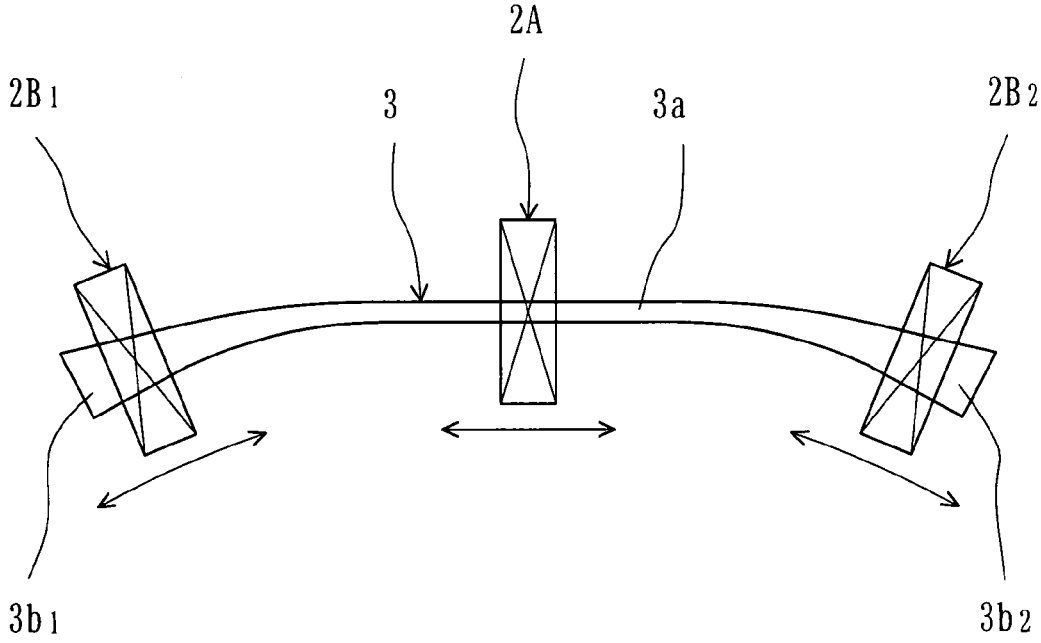
FIG. 4 is a schematic plan view showing an example in which braiding units having different total number of braiding yarn are applied to one mandrel.

Next, a braiding unit moving type braiding apparatus 1 of the present invention will be described in detail based on a specific embodiment shown in the drawings. FIG. 1 is a schematic plan view showing a basic structure of the invention in which a movable braiding unit is disposed in one example of a long mandrel having a curved portion. FIG. 2A is a schematic plan view showing a state in which a braiding unit can move in the X and Y axis directions when the mandrel is deformed as viewed from above, and FIG. 2B is a schematic side view showing a state in which a braiding unit can move also in the Z axis direction when the mandrel is deformed as viewed from side. FIG. 3 is a schematic plan view showing an example of use of a braid converging ring when a braiding unit is added. FIG. 4 is a schematic plan view showing an example in which braiding unit having different total number of braiding yarns are applied to one mandrel.

Figure 5:
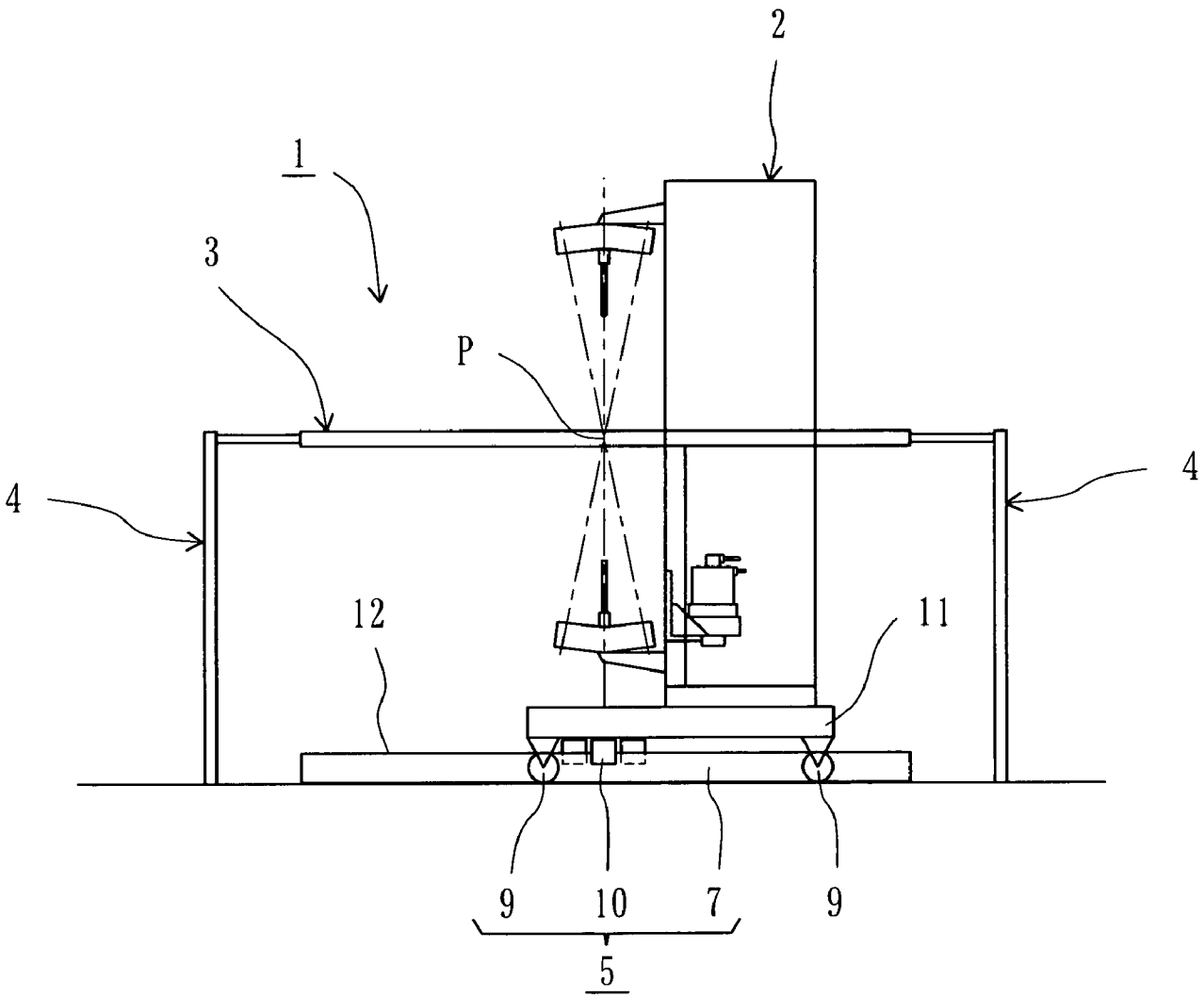
FIG. 5 is a schematic side view showing one example of the braiding unit moving type braiding apparatus of the present invention.
Figure 6:
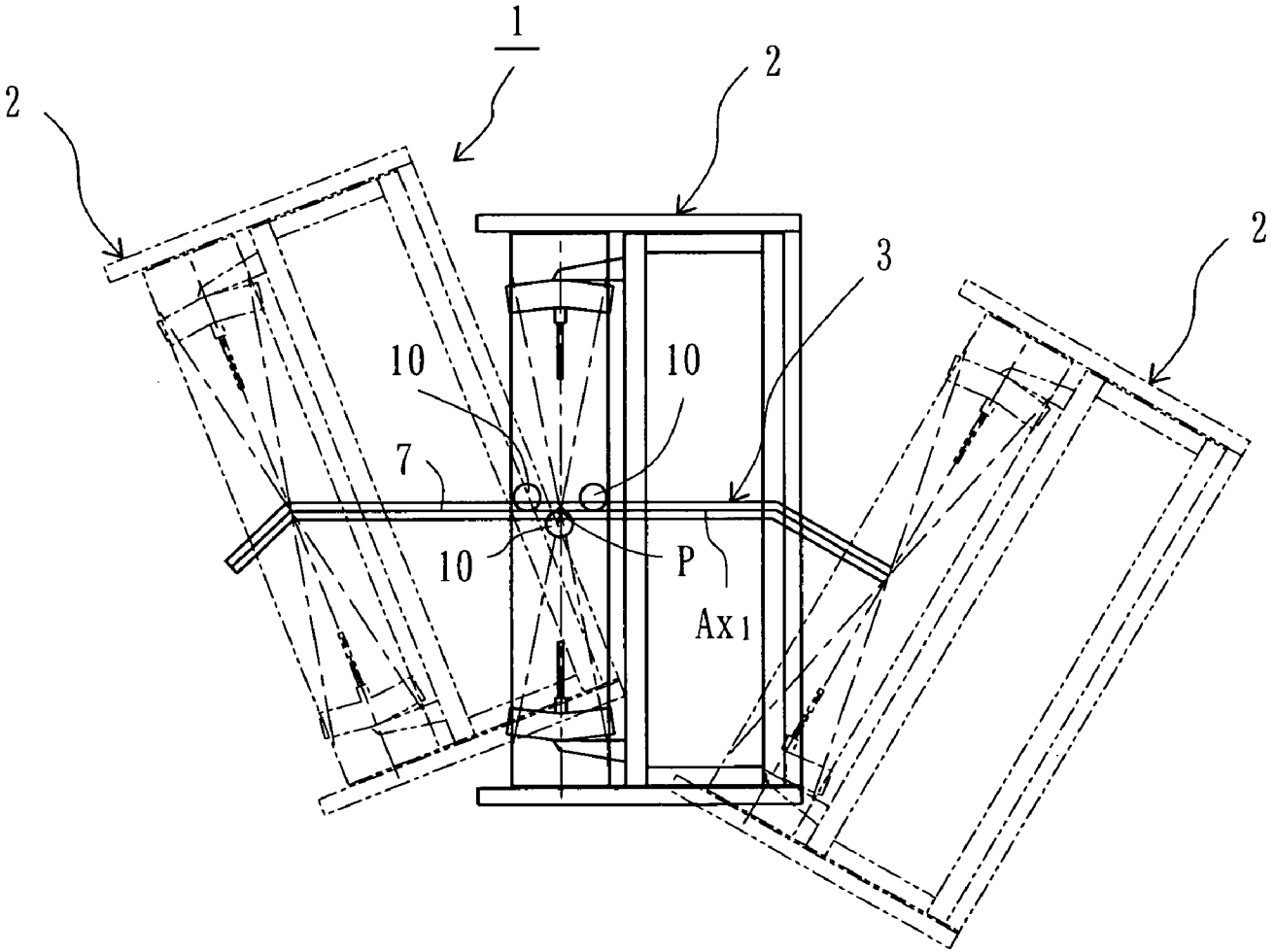
FIG. 6 is a schematic plan view showing a lateral moving state of the braiding unit with phantom lines.
Figure 7:
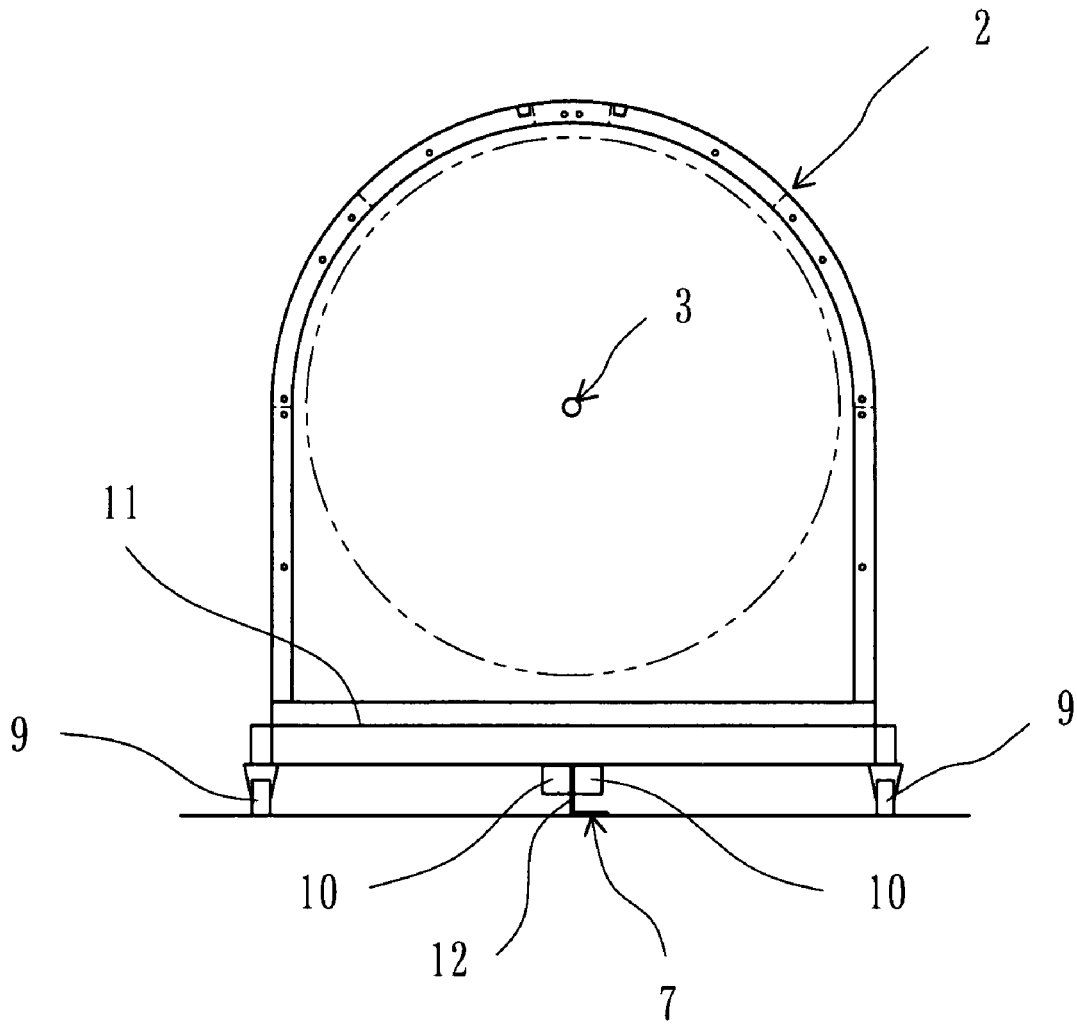
FIG. 7 is a schematic left side view of FIG. 5.
Figure 8:
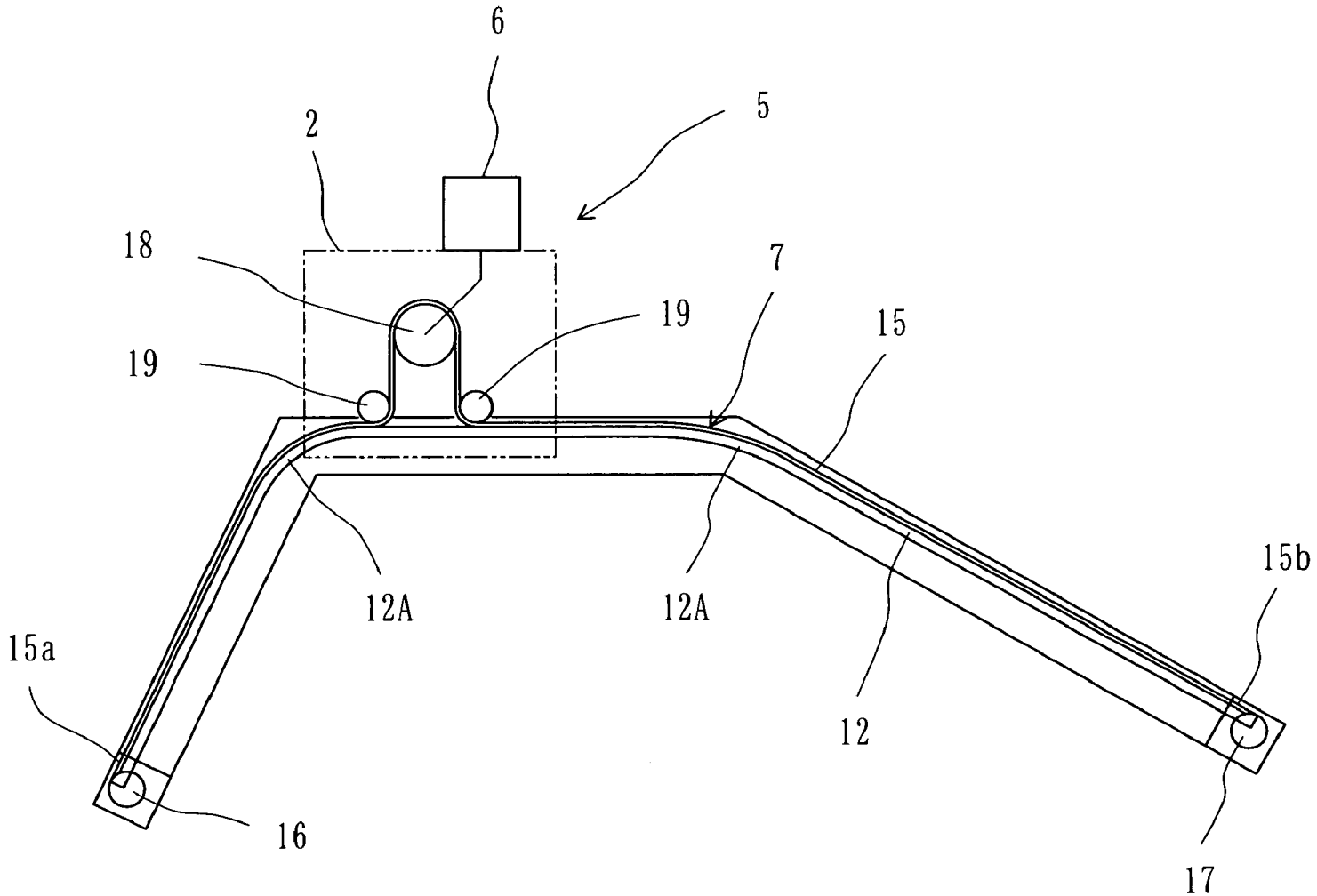
FIG. 8 is a schematic plan view showing a specific embodiment of braiding unit moving means which moves the braiding unit.

FIG. 5 is a schematic side view showing one example of the braiding unit moving type braiding apparatus of the present invention. FIG. 6 is a schematic plan view showing a lateral moving state of the braiding unit with phantom lines. FIG. 7 is a schematic left side view of FIG. 5.

The braiding unit moving type braiding apparatus 1 of the present invention includes a braiding unit 2 which can move along an axis of a mandrel 3, mandrel support means 4 which supports the mandrel 3, and braiding unit moving means 5 which moves the movable braiding unit 2 along the axis of the mandrel 3.

The braiding unit moving means 5 moves the braiding unit 2 along the axis of the mandrel 3. The braiding unit moving means 5 includes a drive source 6 such as a motor, which is provided in the movable braiding unit 2 directly or indirectly. If the drive source 6 is directly disposed in the movable braiding unit 2, the movable braiding unit 2 can be a self-running apparatus. If the drive source 6 is indirectly provided in the movable braiding unit 2, the movable braiding unit 2 can be a drawn apparatus.

A specific embodiment of the braiding unit moving means 5 will be described based on FIGS. 8 to 11. FIGS. 8 to 11 show an example of a structure of a self-running apparatus in which the drive source 6 is directly provided in the braiding unit 2. In the embodiment shown in FIGS. 8 to 11, the braiding unit moving means 5 includes the drive source 6 directly provided in the braiding unit 2, and first guide means 7 including a guide rail 12 which is aligned with an axis Ax1 of the mandrel as viewed from above. The braiding unit 2 can be moved in the X and Y axis directions along the axis Ax1.

The braiding unit moving means 5 is provided along the guide rail 12. The braiding unit 2 is moved by a fixing chain 15 having both ends 15*a* and 15*b* fixed to fixing shaft members 16 and 17, and a drive sprocket 18 which is driven by the drive source 6 provided on the braiding unit 2. In the embodiment shown in the drawings, a pair of guide rollers 10 sandwich the guide rail 12, and the guide rollers 10 and 10 are disposed at front and rear two locations of a composition point position P of the braiding unit 2.

In another embodiment, the braiding unit moving means 5 includes two guide rollers 10 and 10 disposed at a predetermined distance from each other on one side of the guide rail 12 as shown in FIGS. 5 to 7, and another guide roller 10 disposed between the former two guide rollers 10 and 10 on the other side of the guide rail 12.

Figure 9:
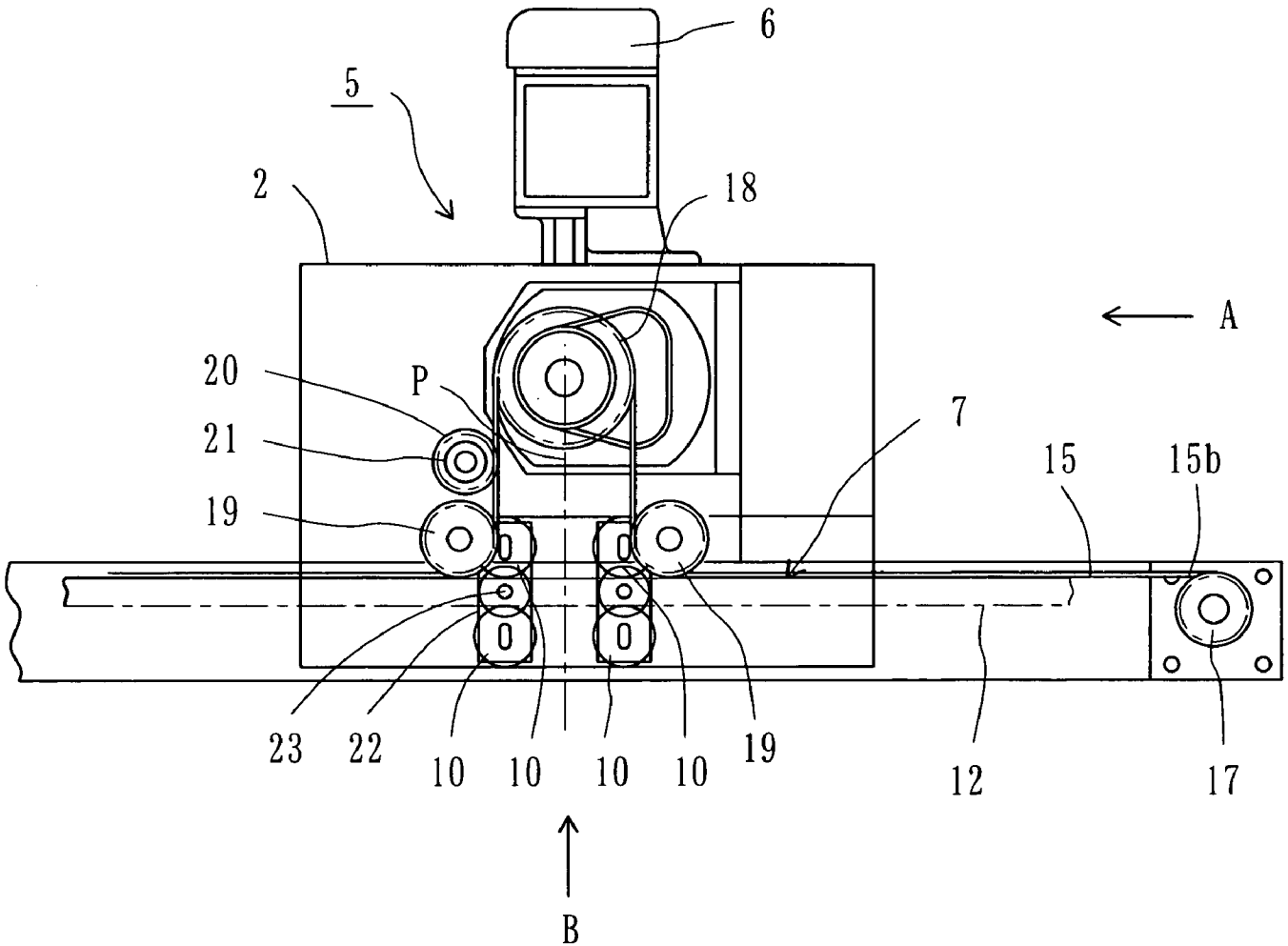
FIG. 9 is an enlarged plan view of an essential portion in FIG. 8.
Figure 10:
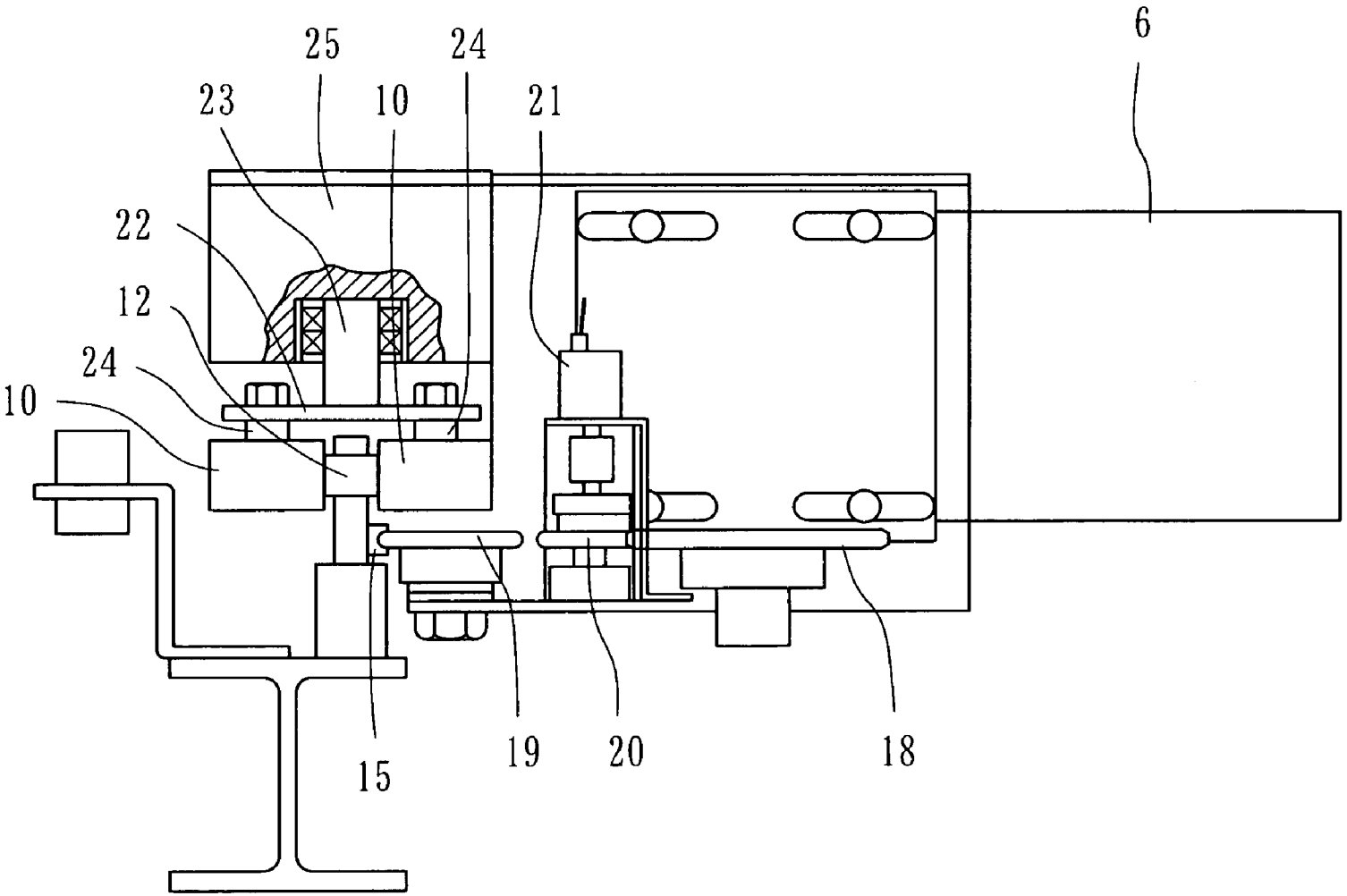
FIG. 10 is a schematic side view of FIG. 9 as viewed from a direction of arrow A.
Figure 11:
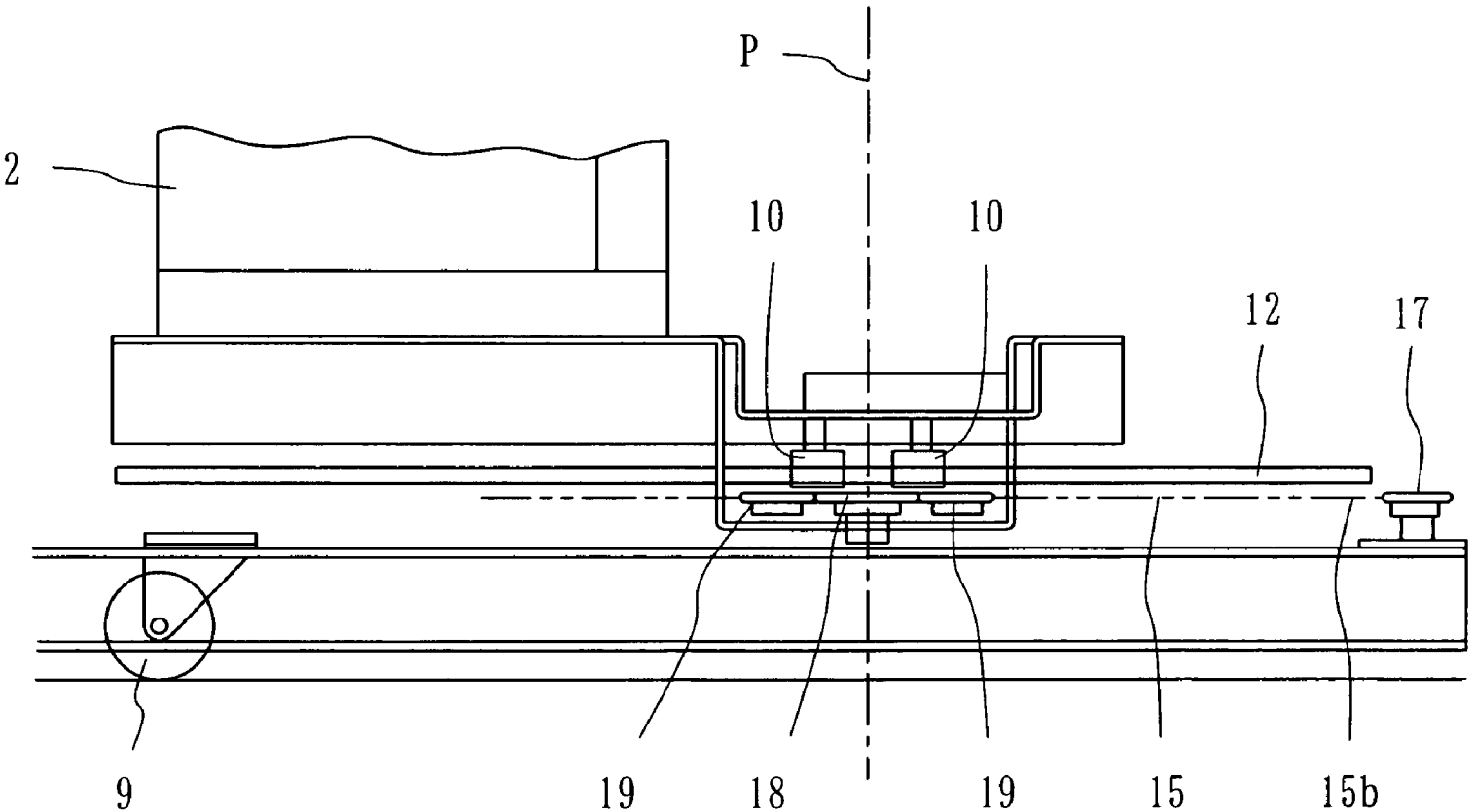
FIG. 11 is a schematic side view of FIG. 9 as viewed from a direction of arrow B.

As shown in FIGS. 9 and 10, in one example, the pair of guide rollers 10 are rotatably supported through supports shafts 24 on both sides in the radial direction of a pivot 23 with respect to a rotation plate 22, and the rotation plate 22 is rotatably supported on a machine body 25 through the pivot 23. The guide rollers 10 and 10 are assembled as described above. Accordingly, when the braiding unit 2 passes through a curved portion 12A of the guide rail 12, the braiding unit 2 can run smoothly. In the drawings, a reference numeral 19 denotes a pair of guide sprockets 19, and a reference numeral 20 denotes a sprocket connected to an encoder 21. The movement of the braiding unit 2 is controlled through the encoder 21.

In the braiding unit moving type braiding apparatus 1 of the present invention, the braiding unit moving means 5 includes second guide means 8 (FIG. 2B) which is aligned to an axis Ax2 of the mandrel as viewed from side in addition to the above-described embodiment, and the braiding unit 2 can be moved in a Z axis direction along the axis Ax2 of the mandrel as viewed from the side. In one example, the second guide means 8 includes a guide surface 13 having a shape corresponding to the axis Ax2 of the mandrel 3 as viewed from the side, and a moving wheel 9. The second guide means 8 may control the mandrel 3 such that the mandrel 3 can move in the vertical direction.

The braiding unit moving means 5 of the braiding unit moving type braiding apparatus 1 of the invention includes the first guide means 7 including the guide rail 12 corresponding to the axis Ax1 of the mandrel as viewed from above, and the second guide means 8 corresponding to the axis Ax2 of the mandrel 3 as viewed from the side. The braiding unit 2 is moved in the X and Y axis directions along the axis Ax1 of the mandrel 3, the braiding unit 2 is moved in the Z axis direction along the axis Ax2 of the mandrel 3 as viewed from the side, and the braiding unit 2 can be moved three dimensionally.

Detailed structure of the movable braiding unit 2 is basically the same as that of the braider BR (see FIGS. 12 and 13). The movable braiding unit 2 is constructed on a dolly 11 having moving wheels 9 and a guide roller 10, and the movable braiding unit 2 can move along the axis of the mandrel 3. This feature is remarkably different from the previous example.

In this invention, as schematically shown in FIGS. 5 to 10, when the mandrel having the curved portion is to be braided, a rotation center of the curved portion when the braiding unit 2 rotates and moves is located substantially on an extension of the composition point P. Since the rotation center when the braiding unit 2 rotates and moves is located on the extension of the composition point P, it is possible to more precisely form a regular braiding layer on the mandrel 3 in agreement with the axis of the mandrel 3. The first guide means 7 including the guide rail 12 and the guide roller 10 can move smoothly either, the straightly moving portion or the curved moving portion of the braiding unit 2.

In the present invention, as shown in FIG. 4, a plurality of braiding units 2 can be added with respect to one mandrel. In this case, the plurality of braiding units 2 can move to an operating position and a standby position in accordance with necessity of production. These braiding units 2 have different total number of braiding yarns, or have bobbin carriers of different fibers. Alternatively, the braiding units 2 may be a combination of ones having different total number of braiding yarns and ones having bobbin carriers of different fibers.

In this invention, the mandrel 3 is fixed. Therefore, even if a number of the braiding units 2 are increased, if the braid converging ring 14 is used as shown in FIG. 3, only a necessary portion in terms of design can be braided, or braiding units 2 having different total number of braiding yarns can be added, and the total number of braiding yarns can be optimized (a using amount is optimized) by varying the cross sectional shape as shown in FIG. 4. According to the example shown in FIG. 4, a portion 3*a* of the mandrel having a small diameter is braided by a braiding unit 2A having a small number of braiding yarns, and portions 3*b*1 and 3*b*2 of the mandrel having large diameters are braided by braiding units 2B1 and 2B2 having a larger number of braiding yarns. In such an embodiment, the mandrels are braided to respective diameters, the braiding units 2B1 and 2B2 are retreated, and each mandrel is braided over its entire length by the braiding unit 2A.

When braiding units 2 are exchanged as shown in FIG. 3, and when the braid converging ring 14 cuts a braid between the braiding unit 2 and a braiding layer which is being braided, ends of braids at the bobbin carrier side are collectively held. When using the braiding unit is again used, the braid converging ring 14 is fitted into the mandrel 3 and in this state, the braiding unit 2 is moved to a predetermined position of the mandrel 3, and the braiding is re-started. The braid converging ring 14 facilitates the processing of braid ends when the braiding units 2 are exchanged.

In the braiding unit moving type braiding apparatus 1 of the invention, as compared with the conventional fixed multi-braiding units (see FIGS. 1 and 4 of Japanese Patent Application Laid-open No. H8-276502), the production efficiency can be enhanced. That is, in the conventional fixed multi-braiding units, a pulling out speed of the mandrel is constant, a braiding speed of each braiding unit varies, a braiding angle and the like are controlled, speeds of the respective braiding units are associated with each other and thus, the production speed is determined by the pulling out speed of the mandrel. In this regard, in the braiding unit moving type braiding apparatus of the present invention, since the braiding speed and the moving speeds of the respective braiding units independently vary, each braiding unit can be set independently and thus, the production speed can be enhanced as compared with the conventional apparatus.

In the above-described conventional fixed multi-braiding units, the mandrel moves by a distance corresponding to the machine base length. Therefore, when this mandrel is to be pulled out, a braid connected to the mandrel having the machine base length is generated, and this braid becomes waste. According to the braiding unit moving type braiding apparatus of the present invention, since a braid can be cut between each braiding unit and the mandrel, no waste is generated. In this case, the braid is cut using the braid converging ring as shown in FIG. 3 in each braiding unit, so that almost no waste is generated. Further, cut braid ends of a large number of bobbin carriers are not scattered, they can collectively be held on the braid converging ring and thus, the braiding operation can easily be re-started at a next braiding position.

The invention claimed is:

1. A braiding unit moving type braiding apparatus, comprising:

braiding unit moving means for moving a braiding unit along an axis of a mandrel having bent portions to compose a braiding layer around the mandrel, said braiding unit moving means including a drive source which is directly or indirectly provided in the braiding unit, and first guide means aligned with an axis (Ax1) of the mandrel as viewed from above, said first guide means comprising a guide, a guide rail aligned with said axis (Ax1), and a pair of guide rollers which is provided at a side of the braiding unit and contacts both sides of the guide rail, and said braiding unit is guided so that a rotation center of the braiding unit when it is rotated and moved is located substantially on an extension line of a composition point.

2. The braiding unit moving type braiding apparatus according to claim 1, in which said braiding unit moving means includes second guide means aligned with an axis (Ax2) of the mandrel as viewed from a side of the mandrel.

3. The braiding unit moving type braiding apparatus according to claim 1, and mandrel moving means for moving the mandrel in a vertical direction while the braiding unit moves along the axis (Ax1) of the mandrel as viewed from above.

4. The braiding unit moving type braiding apparatus according to claim 1, wherein the braiding unit comprises a plurality of braiding units.

5. The braiding unit moving type braiding apparatus according to claim 4, wherein the plurality of braiding units move to an operating position and a standby position in accordance with necessity of production.

6. The braiding unit moving type braiding apparatus according to claim 4, wherein the plurality of braiding units have different total number of braiding yarns, and/or bobbin carriers of different fibers.

* * * * *